United States Patent [19]

Deer

[11] 4,171,010

[45] Oct. 16, 1979

[54] FLAPPER RETRACTOR

[75] Inventor: Carmine Deer, Westfield, N.J.

[73] Assignee: Flagstaff Corporation, New York, N.Y.

[21] Appl. No.: 901,286

[22] Filed: May 1, 1978

[51] Int. Cl.[2] ..... B65B 3/04

[52] U.S. Cl. ..... 141/369; 221/312 R

[58] Field of Search ..... 141/392, 165, 166, 173, 141/174, 175, 369–381, 312; 160/190; 221/312 R

[56] References Cited

U.S. PATENT DOCUMENTS 4,079,771 3/1978 Theiss ..... 160/90

*Primary Examiner*—Houston S. Bell, Jr.

*Attorney, Agent, or Firm*—Lerner, David, Littenberg & Samuel

[57] ABSTRACT

In machines for vending liquids into cups, a cup guide and a cup stabilizing flapper are used to place the cup in position to receive the selected liquid. A flapper retractor apparatus is connected to the vending machine sliding door so that when a user opens the door to remove a filled cup, the cup flapper is simultaneously moved aside by the flapper retractor so that the filled cup may be more easily removed.

6 Claims, 1 Drawing Figure

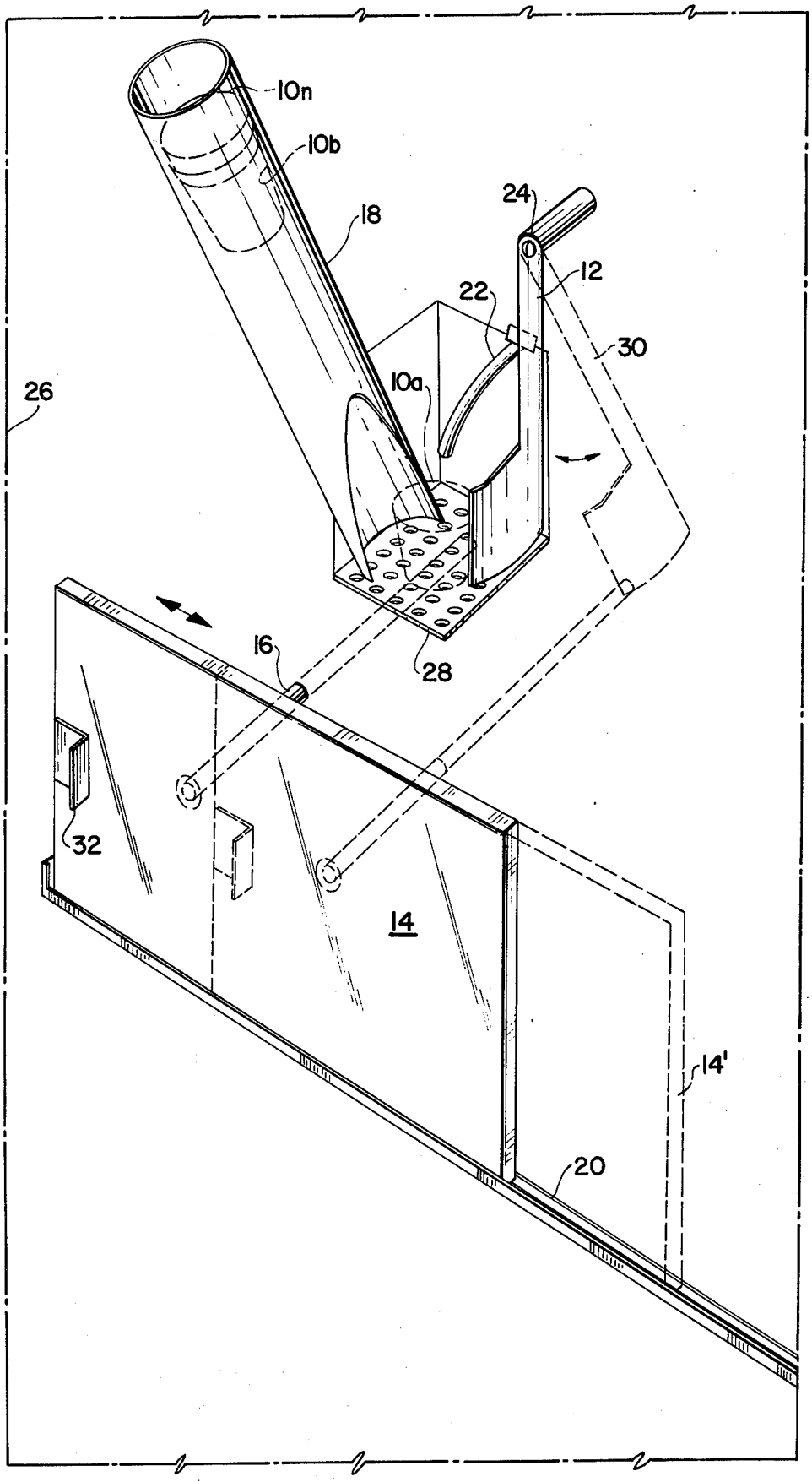
10n
10b
18
24
12
22
30
10a
26
16
28
32
14
14'
20

FLAPPER RETRACTOR

BACKGROUND OF THE INVENTION

This invention relates to vending machines, and more particularly to a vending machine for dispensing open topped disposable cups filled with a liquid.

There are currently available several varieties of such machines, most of which include a cup guide for guiding one cup at a time to a liquid receiving position under a spout, and a cup flapper positioned opposite the cup guide for stabilizing the cup when it reaches the end of its journey down the cup guide to an upright liquid receiving position. A sliding transparent door is normally placed in front of the above-mentioned apparatus which must be opened in order for the consumer to remove the filled cup.

Persons who are experienced in the use of such currently available vending machines are aware of the difficulty which sometime accompanies an attempt to remove a filled cup from the machine. The consumer must contend with the sliding door, the cup flapper and the cup itself. A not uncommon result is a partial spill with the accompanying burning sensation experienced by the consumer's fingers. This is especially likely to happen when the consumer attempts to accomplish the cup removal process with a single hand.

U.S. Pat. No. 2,782,810 issued to R. L. Richter on Feb. 26, 1957 discloses a vending machine having a cup dispenser closure member which is actuated by opening a see-through door through which one removes a filled cup. When the door opens, the closure member moves into a position to prevent the consumer from reaching other interior portions of the machine including in particular the stack of empty cups.

U.S. Pat. No. 2,830,627 issued to S. C. Polsen et al on Apr. 15, 1958 shows the use of a see-through door on a vending machine which, when being opened, simultaneously causes a pair of arms to swing upwardly into a position directly beneath the dispensing spout to provide a guard which prevents anyone reaching into the machine from touching the spout.

U.S. Pat. No. 3,586,074 issued to I. F. Snyder on June 22, 1971 discloses a spring-loaded wire cup guide which is moved out of the way by pressure from the side of the cup as the cup itself is being removed by the consumer. Once the cup is removed, the guide slips back to its guiding position. The apparatus of Snyder is not actuated by or related to the movement of an access door.

It is therefore an object of the instant invention to provide a movable flapper apparatus for properly positioning a cup in a vending machine and a flapper retractor for increasing the ease of access to and removal of the cup from the machine.

SUMMARY OF THE INVENTION

The invention comprises apparatus for moving a cup stabilizing flapper out of contact with and away from a cup in a dispensing machine, whereby the movement of the flapper is initiated and actuated in conjunction with the opening of an access door for removal of the cup from the machine. This invention allows the consumer to have free access to the cup without having to contend with the presence of the cup stabilizing flapper while removing the cup from the machine. When the access door returns to its normally closed position, the flapper retractor apparatus allows the flapper to return to its cup receiving position where it can perform its stabilizing function on a subsequently supplied cup. By means of this invention the removal of a filled cup from a vending machine is rendered simpler and safer than it was when using the prior art apparatus. Partial spills are less likely to occur, and removal of a filled cup from the machine with one hand is now much more easily accomplished.

BRIEF DESCRIPTION OF THE DRAWING

The foregoing will be more readily understood upon a reading of the following detailed description in conjunction with the accompanying drawing wherein is depicted a perspective view of the preferred embodiment of a flapper retractor in accordance with the principles of this invention.

DETAILED DESCRIPTION OF THE PREFERRED EMBODIMENT

Referring now to the accompanying figure, depicted therein is a break-away perspective view of the apparatus of the preferred embodiment of the instant invention. The apparatus shown is contained within a vending machine whose outer frame is shown in the figure as a dotted line box 26. Contained within the vending machine are several components pertinent to the instant invention. Cup guide chute 18 guides cups 10*a*, 10*b*, . . . , 10*n* one at a time down to the liquid receiving position on drain plate 28. Cup stabilizing flapper 12 pivots on flapper pivot hinge 24, and serves to situate the cup in its proper liquid receiving position (as shown for cup 10*a*) once the cup exits the bottom of the cup guide chute 18. The liquid is then dispensed through spout 22 into the cup.

Upon the machine's completion of the dispensing of liquid into the cup 10*a*, the consumer gains access to the filled cup by grasping the handle 32 of the sliding door 14 and moving the door to an open position (shown by dotted lines 14') along door guide 20. Concurrent with the opening of the sliding door 14, the flapper retractor 16 which is attached to the door and protrudes inwardly to the flapper 12, moves the flapper to a retracted position (shown by dotted lines 30) out of the way of the filled cup.

Once the consumer has removed the filled cup 10*a*, the sliding door 14 closes and the protruding flapper retractor 16, attached thereto returns to its original cup receiving position, thus allowing flapper 28 to return to its original cup stabilizing position ready for cup 10*b* to be supplied down cup guide chute 18.

The flapper retractor 16 is attached to the sliding door 14 in any convenient manner such as bolting, glueing, etc. Flapper retractor 16 does not interfere in any way with the stabilizing action of cup stabilizing flapper 12, and does not cause appreciable resistance to the opening of sliding door 14.

It is to be understood that the above-described preferred embodiment is merely illustriative of the application of the principles of this invention. Numerous other arrangements may be devised by those skilled in the art without departing from the spirit and scope of this invention as defined by the following claims. In particular, for example, the exact shape and location of the flapper retractor are not limited to the particular apparatus described above.

What is claimed is:

1. A cup dispensing apparatus comprising a cup support, cup dispensing means for dispensing a cup onto said support, a cup stabilizing flapper for stabilizing said cup on said support, said flapper being movable from a first cup stabilizing position to a second position remote therefrom, an access door, and means responsive to the opening of said door for moving said flapper from said first position to said second position, whereby said cup may be removed without interference from or contact with said flapper.

2. The apparatus of claim 1, wherein said flapper moving means comprises mechanical means connected to said door which directly contacts said flapper when said door is being opened.

3. The apparatus of claim 2, wherein said mechanical means comprises an appendage connected to the inside of said door which extends inwardly to said flapper.

4. The apparatus of claim 3, wherein said appendage comprises a rod.

5. The apparatus of claim 4, wherein said rod comprises a solid round rod of constant cross-sectional area.

6. The apparatus of claim 1, wherein said apparatus further comprises dispensing means for dispensing liquid into said cup while said cup is in its stabilized position.

* * * * *